United States Patent [19]

Yoshizumi

[11] Patent Number: 4,488,022

[45] Date of Patent: Dec. 11, 1984

[54] MECHANISM FOR ADJUSTING THE SPEED OF DISPLACEMENT OF AN ARC CONTACT FOR A SWITCHING APPARATUS

[75] Inventor: Toshiaki Yoshizumi, Minoo, Japan

[73] Assignee: Mitsubishi Denki Kabushiki Kaisha, Tokyo, Japan

[21] Appl. No.: 438,691

[22] Filed: Nov. 2, 1982

[30] Foreign Application Priority Data

Nov. 12, 1981 [JP] Japan ..... 56-182552

[51] Int. Cl.[3] ..... H01H 33/12

[52] U.S. Cl. ..... 200/146 R; 200/34; 200/144 AP

[58] Field of Search ..... 200/144 AP, 146 R, 34

[56] References Cited

U.S. PATENT DOCUMENTS

| | | | |
|---|---|---|---|
| 1,551,372 | 8/1925 | Crocker | 200/34 |
| 2,666,827 | 1/1954 | Van Ryan | 200/34 |
| 3,045,076 | 7/1962 | Gaylord | 200/34 |
| 3,374,320 | 3/1968 | Buhler et al. | 200/34 |

FOREIGN PATENT DOCUMENTS

| | | | |
|---|---|---|---|
| 272156 | 4/1965 | Australia | 200/144 AP |
| 54-113874 | 9/1979 | Japan . | |
| 54-179469 | 12/1979 | Japan . | |

*Primary Examiner*—Robert S. Macon

*Attorney, Agent, or Firm*—Leydig, Voit, Osann, Mayer and Holt, Ltd.

[57] ABSTRACT

The invention relates to a mechanism for adjusting the speed of movement of an arcing contact for a switching apparatus for preventing main contacts of the apparatus from being damaged by arcing. A support that supports an arcing contact and a cylinder accommodating a piston secured to the support are formed respectively with nozzle grooves and nozzle holes. The nozzle grooves and nozzle holes serve to communicate the inside and outside of the cylinder and adjust the speed of movement of the arcing contact according to the movement of the arcing contact. The way in which the speed of movement of the arcing contact is adjusted can be varied by varying the shape and length of the grooves formed in the support.

7 Claims, 10 Drawing Figures

MECHANISM FOR ADJUSTING THE SPEED OF DISPLACEMENT OF AN ARC CONTACT FOR A SWITCHING APPARATUS

BACKGROUND OF THE INVENTION

This invention relates to a mechanism for adjusting the speed of movement of an arcing contact for a gas insulated disconnector or gas insulated circuit breaker constituting part of a gas insulated switching apparatus for a power station or the like for preventing the main contacts from damage due to the arc discharge.

Many switching apparatus used for power stations are required to have a function of interrupting the current flowing therethrough. A circuit breaker, for instance, is required to have a function of interrupting an accidental current as well as the rated current. A disconnector is required to have a function of interrupting the loop current caused at the time of switching of systems. Further, a grounded switch is required to interrupt current induced in a stand-by circuit due to induction in another circuit.

Further, at the time when a current is interrupted, an arc is produced between the main contacts of the switching apparatus. To prevent damage to the main contacts from this arcing, a switching apparatus is usually provided with arcing contacts which are separate from the main contacts. The arcing contacts are roughly classed into those capable of moving with the movement of a main contact and those fixed in position irrespective of the movement of any main contact. The present invention pertains to a switching apparatus which incorporates the former arcing contacts.

SUMMARY OF THE INVENTION

An object of the invention is to provide a mechanism for adjusting the speed of movement of an arc contact following the movement of a main contact in a switching apparatus, which can prevent the main contact from being damaged due to arcing.

BRIEF DESCRIPTION OF THE DRAWINGS

In the drawings, the same reference numerals designate similar like parts.

DESCRIPTION OF THE PREFERRED EMBODIMENTS

Now a disconnector having two disconnecting switches, to which the invention is applicable, will be described.

Figure 1:
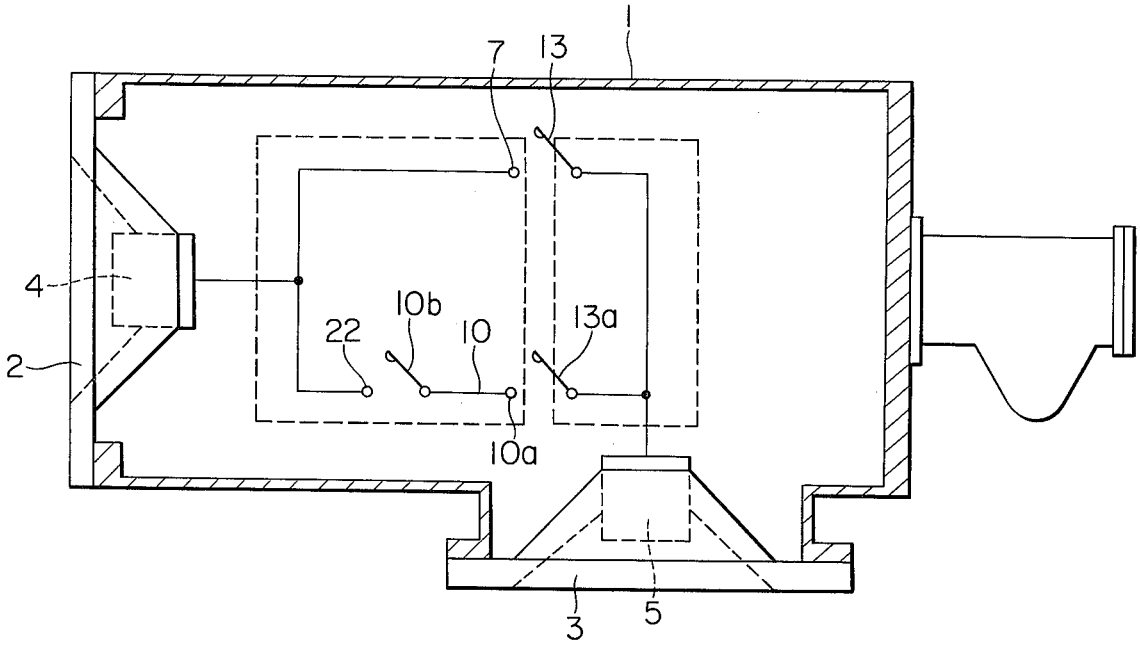
FIG. 1 is a view showing a disconnector to which the invention is applicable.
Figure 2:
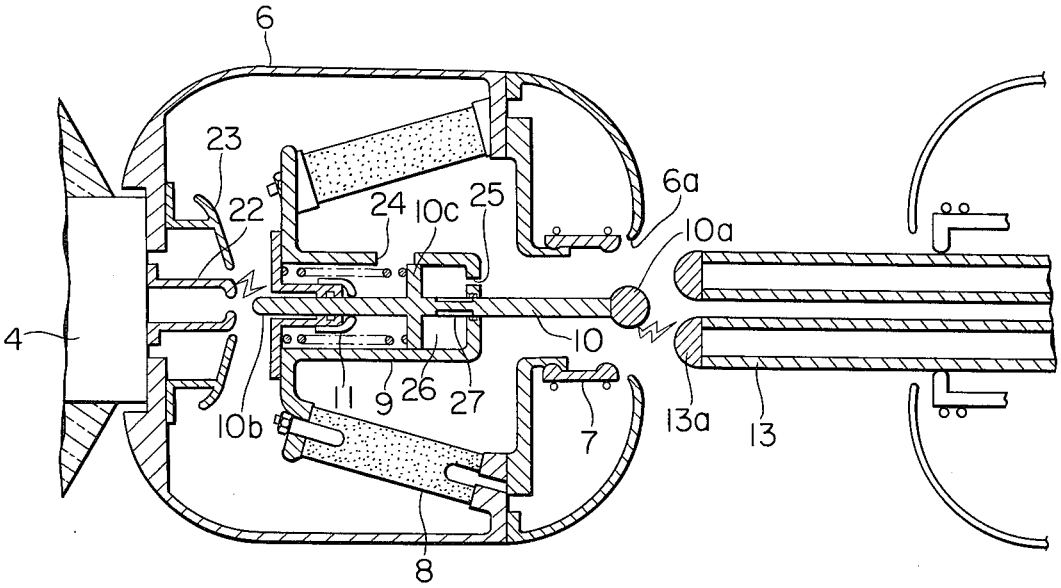
FIG. 2 is a longitudinal sectional view showing an embodiment of the invention applied to the disconnector shown in FIG. 2.
Figure 3:
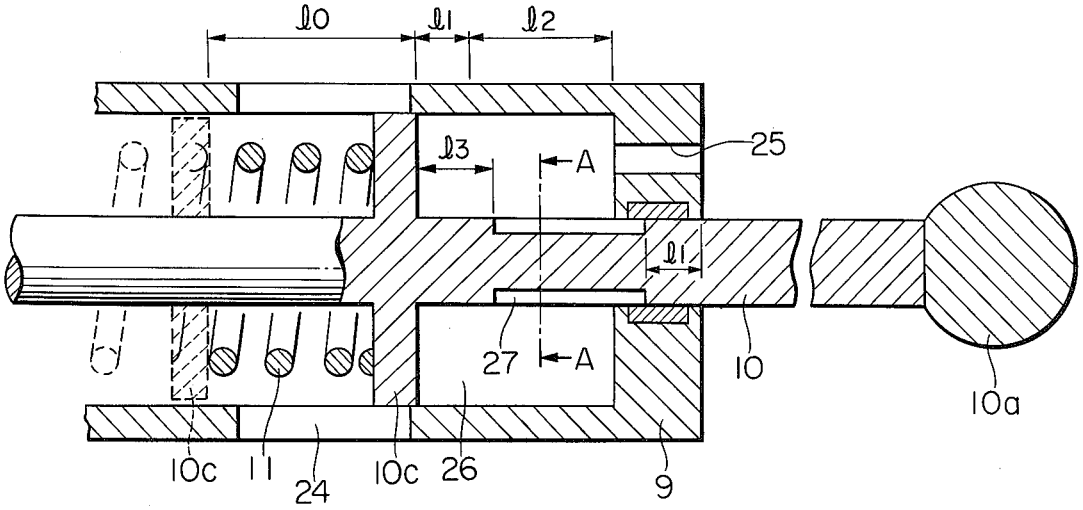
FIG. 3 is a fragmentary longitudinal sectional view showing a mechanism of adjusting the speed of movement of an arcing contact in the embodiment of FIG. 2.

FIG. 1 is a view showing a commonly termed two-point disconnector having two disconnecting switches. FIG. 2 shows a specific example of the construction of the stationary side of the disconnector. FIG. 3 is an enlarged-scale view of an essential part of the structure shown in FIG. 2.

Referring to FIG. 1, a tank 1, which is filled with gas capable of extinguishing an arc, is sealed by insulating spacers 2 and 3. Conductors 4 and 5 are secured to the respective spacers 2 and 3. Referring to FIG. 2, a shield member 6 having an opening 6*a* is secured to the conductor 4. The shield 6 is made of a conducting material. A stationary contact 7 is disposed in the shield 6 such that it faces the opening 6*a* thereof. The stationary contact 7 is secured to the shield 6 and electrically connected thereto. An insulator 8 is secured at one end to the shield 6. A cylinder 9 is secured to the other end of the insulator 8. A conductive support 10 extends through the stationary contact 7 and is movably supported in the cylinder 9. An arc contact 10*a* which is capable of withstanding repetitive arcs is secured to one end of the conductive support 10. The support 10 is connected to the other end of the insulator 8 via a cylinder 9. A movable contact 13 is provided at one end with an arc contact 13*a* capable of withstanding repetitive arcs. As the movable contact 13 is moved to the right in FIG. 2, it is disconnected from the stationary contact 7 and then disconnected from the arc contact 10*a*. Arc contacts 10*b* and 22 are provided as second arc contacts in series with the first arc contact 10*a* and 13*a*. Of the second arc contacts, the movable arc contact 10*b* is integral with the arc contact 10*a* and thus has the same function as the first arc contact 10*a*. The arc contact 22 is on the stationary side. A shield 23 is provided to alleviate the electric field between the arc contacts 10*b* and 22. Referring to FIG. 3, numerals 24, 25 and 27 designate nozzle holes for controlling the operating speed of the arc contact 10*a*. A movable piston 10*c* which is spring biased by a spring 11 can compress the gas filling a spring case 9 to let the gas be discharged through the nozzles 24, 25 and 27. Referring to FIG. 2 again, the second arc contacts 10*b* and 22 must be disconnected before or after the first arc contacts 10*a* and 13*a* are disconnected. To this end, it is necessary to tentatively reduce the speed of the arc contact 10*a* during its operation.

To meet this necessity, the invention features the following construction. When a disconnecting command is given to the disconnector shown in FIG. 2, the movable contact 13 starts to be moved to the right. With the movement of the movable contact 13, the arc contact 10*a* is forced by the spring 11 until the movable contact 13 is broken apart from the stationary contact 7.

Figure 4:
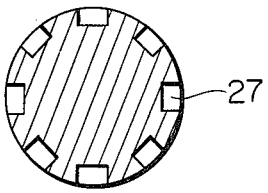
FIG. 4 is a sectional view taken along line A—A in FIG. 3.

In FIG. 3, shown by dashed lines is the position of the piston 10*c* when the disconnector is in its completely closed state. While the piston 10*c* is displaced to the right from the position mentioned above for a distance $l_0$, the speed of the arc contact 10*a* and the piston 10*c* integral therewith will not be reduced because an opening 24 is provided in the cylinder 9. When the distance covered by the piston 10c exceeds $l_0$, the gas confined in the space 26 defined by the cylinder 9 and piston 10c now can flow out only through a narrow nozzle 25 so that the pressure in the space 26 is increased. As a result, a reaction force is exerted to the piston 10c in the direction opposite to the biasing direction of the spring 11. Thus, the speed of the arc contact 10a is quickly reduced. When the distance covered by the piston 10c exceeds an extra distance $l_1$, the right hand end of peripheral nozzles 27 formed on the support 10 get out of the cylinder 9 so that the cylinder space 26 is communicated with the outside of the cylinder 9 via the nozzles 27. If the nozzles 27 have a sectional profile as shown in FIG. 4 so that their sectional area is sufficiently large compared to the sectional area of the nozzle 25, the gas pressure in the cylinder space 26 is quickly reduced at this time. As a result, the arc contact 10a begins to be accelerated again by the biasing force of the spring 11. The piston 10c is further moved to the right until it covers a remaining distance $l_2$. If the nozzles 27 formed on the support 10 have their other ends nearest the piston 10c positioned at a distance $l_3$ from the pistion 10c, the speed of the arc contact 10a will be reduced once again when the piston 10c reaches a position leaving the distance $l_3$ in its stroke as is apparent from the previous description.

Figure 5:
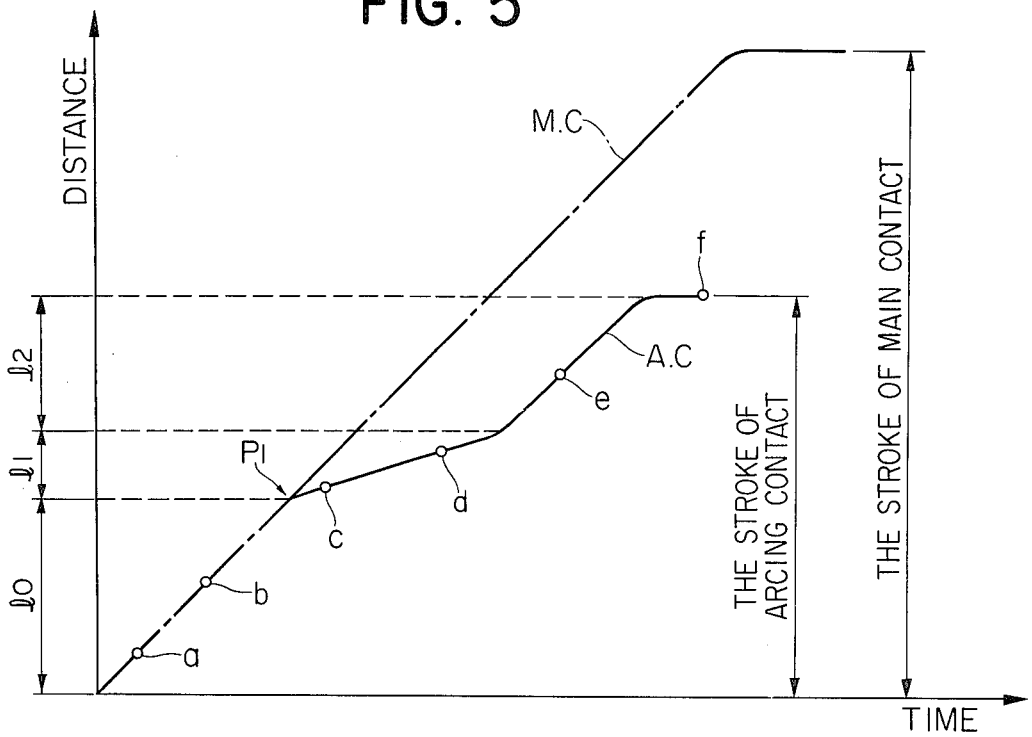
FIG. 5 is a view showing the distance covered by an arcing contact and a main contact in the embodiment of FIG. 2 plotted against time.

FIG. 5 shows the distance covered by the arc contact 10a and piston 10c and also by the main contact 13 plotted against time. Plot MC represents the stroke of the main contact 13, and plot AC represents the stroke of the arc contact 10a. In the stroke of the plot AC, for a portion a-b, the arc contact is accelerated at the same speed as the main contact, in a portion b-c it is broken apart from the main contact, in a portion c-d its speed is reduced, in a portion d-e its speed is increased again, and its increased speed is maintained for the remaining part of the stroke. At point P1 the arc contact 10a is quickly decelerated and is disconnected from its mate arc contact 13a. At this time, the speed of the main contact 13 is not substantially changed, so that the distance between the arc contacts 10a and 13a are increased while the distance $l_1$ is covered by the arc contact 10a. Substantially at the same time, the second arc contacts 10b and 22 are disconnected, and the distance between them is subsequently increased gradually.

As has been shown in the above, when the construction according to the invention is applied to a disconnector or a circuit breaker, the speed of the arc contacts can be controlled without the use of any external force. In other words, it is possible to adjust the timing at which the arc contact and the main contact are disconnected and also control the distance between these contacts after they have come apart.

Figure 6:
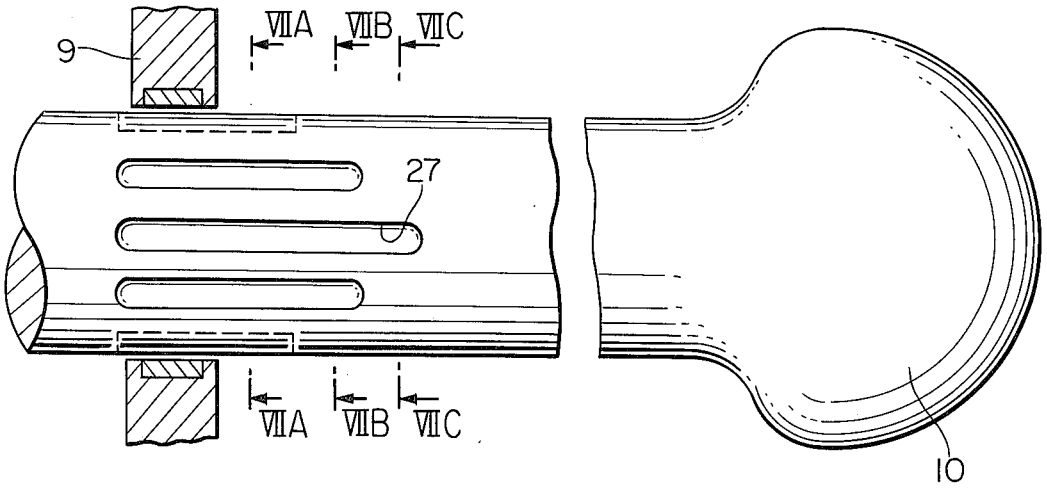
FIG. 6 is a front view, partly broken away showing an adjusting mechanism in a different embodiment of the invention.
Figure 7:
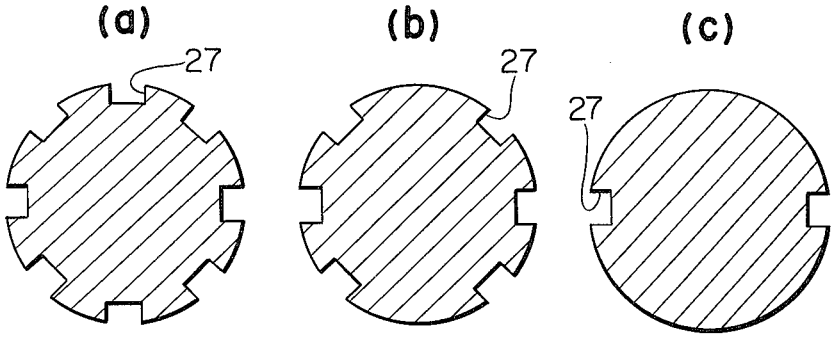
FIG. 7A is a sectional view taken along line VIIA—VIIA in FIG. 6.
FIG. 7B is a sectional view taken along line VIIB—VIIB in FIG. 6.
FIG. 7C is a sectional view taken along line VIIC—VIIC in FIG. 6.

FIG. 6 shows a different embodiment of the invention. Here, like the case of FIG. 2, the support 10 is formed with peripheral nozzles 27. These nozzles 27 however, have different lengths. With this arrangement, as the support 10 is moved to the right past the spring case 9, the sectional profile of the nozzles 27 communicating with the cylinder space 26 and the outside of the cylinder are progressively changed from that shown in FIG. 7(*a*) to that shown in FIG. 7(*b*) and then to that shown in FIG. 7(*c*). Thus, it is possible to obtain smoother acceleration and deceleration of the arcing contact 10a.

Figure 8:
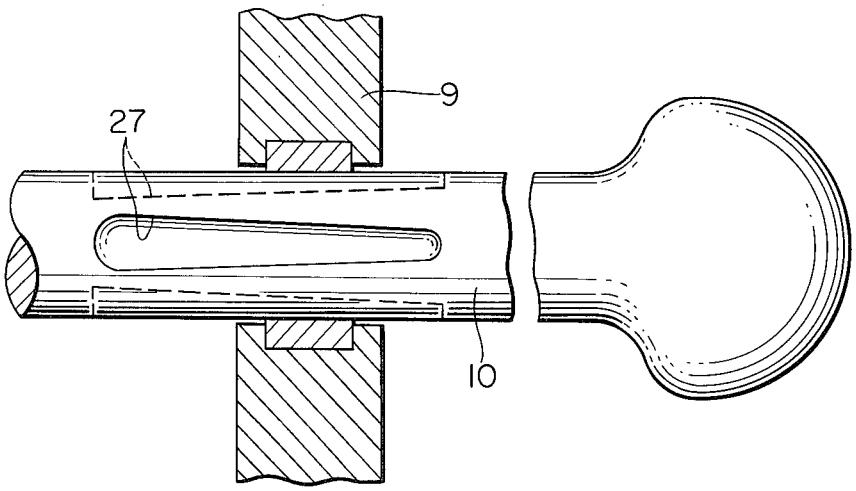
FIG. 8 is a front view, partly broken away, showing an adjusting mechanism in a further embodiment of the invention.

FIG. 8 shows a further embodiment of the invention. Similar to the case of FIG. 2, the support 10 is formed with peripheral nozzles 27. In this case however, the width and depth of the nozzles 27 linearly increases in the direction away from the arcing contact. Thus, as in the case of FIG. 6 the sectional area of the nozzles is progressively changed with the movement of the support 10, and thus the same effects as described above can be obtained.

While the above embodiments of the invention relate to disconnectors, the invention can be applied to other types of switching devices as well.

Further, the nozzles 25 in the above embodiments may be replaced with suitable grooves to obtain the same function.

What is claimed is:

1. A mechanism for adjusting the speed of displacement of an arc contact for a switching apparatus comprising:

a pair of main contacts provided in the switching apparatus, one of said main contacts being movable;

an arc contact which engages said movable main contact and follows the movement of said movable main contact in the disconnecting direction;

a movable piston provided on a support supporting said arc contact and a stationary cylinder accommodating said piston; and means for controlling the speed of movement of said arc contact relative to the movement of said main contact including one or more nozzle holes formed in said cylinder and one or more nozzle grooves formed in said support, said nozzle holes and nozzle grooves being arranged to communicate the inside and outside of said cylinder and control the speed of movement of said piston.

2. The mechanism for adjusting the speed of displacement of an arc contact for a switching apparatus according to calim 1, wherein a plurality of nozzle grooves are formed on the outer periphery of said support and circumferentially uniformly spaced apart, said nozzle grooves being capable of communicating the inside and outside of said cylinder.

3. The mechanism for adjusting the speed of displacement of an arc contact for a switching apparatus according to claim 1, wherein a plurality of nozzle grooves are formed on the outer periphery of said support, at least one of said nozzle grooves being different in length from the remaining nozzle grooves.

4. The mechanism for adjusting the speed of displacement of an arc contact for a switching apparatus according to claim 1, wherein said nozzle grooves formed on said support each have a sectional area varying in the longitudinal direction of said support.

5. The mechanism for adjusting the speed of displacement of an arc contact for a switching apparatus according to claim 1, wherein said pair of main contacts consist of a stationary main contact and a movable main contact, said arcing contact being provided on the side of said stationary main contact.

6. The mechanism according to claim 1, wherein a second arc contact is interconnected with said first mentioned arc contact and said piston, the speed of movement of both arc contacts being controlled by said means.

7. The mechanism according to claim 1, wherein said nozzle holes and nozzle grooves are arranged with varying sectional areas during different stages of movement of said piston to vary the speed of movement of said arc contact relative to the movement of said main contact in the disconnecting direction.

* * * * *